US005544495A

United States Patent [19]

Anderson et al.

[11] Patent Number: 5,544,495

[45] Date of Patent: Aug. 13, 1996

[54] CONSTRUCTION OF REFRIGERATED CONTAINERS

[75] Inventors: Bruce Anderson; Philip Gipson, both of Naples, Fla.

[73] Assignee: Frigid-Rigid, Inc., Naples, Fla.

[21] Appl. No.: 388,282

[22] Filed: Feb. 14, 1995

[51] Int. Cl.[6] ..... F25D 3/08; F25B 39/02

[52] U.S. Cl. ..... 62/457.7; 62/518; 62/298

[58] Field of Search ..... 62/457.1, 457.9, 62/440, 516, 518, 298; 165/905; 312/116, 401, 406

[56] References Cited

U.S. PATENT DOCUMENTS

| | | | |
|---|---|---|---|
| 3,605,431 | 9/1971 | Carson | 62/457.9 |
| 3,772,113 | 11/1973 | Patrick | 156/94 |
| 3,953,394 | 4/1976 | Fox et al. | 260/40 R |
| 3,959,209 | 5/1976 | Lalle | 260/40 R |
| 4,308,226 | 12/1981 | Wingard | 264/45.3 |
| 4,719,968 | 1/1988 | Speros | 165/154 |
| 4,951,481 | 8/1990 | Negishi | 62/406 |
| 5,259,506 | 11/1993 | Pascale et al. | 206/545 |

*Primary Examiner*—William Doerrler
*Attorney, Agent, or Firm*—Roland H. Shubert

[57] ABSTRACT

A refrigerated container, that can be economically manufactured in a variety of incrementally different sizes and shapes, is provided as well as are techniques for making those containers. The containers include an inner shell of fiber reinforced resin enclosing a space that is refrigerated by an evaporator coil arranged on the outer side of the shell. The coil is bonded to the shell, and a heat transmitting layer between evaporator coil turns is formed using a heat conducting adhesive material having metal granules dispersed in a resin base.

16 Claims, 2 Drawing Sheets

CONSTRUCTION OF REFRIGERATED CONTAINERS

TECHNICAL FIELD

This invention relates generally to freezers, coolers, and other refrigerated containers and to methods for their construction.

Specific embodiments of this invention are directed to molded refrigerated containers of incrementally different sizes and shapes having integral evaporators, and to methods for their construction.

BACKGROUND ART

The inventor's prior U.S. Pat. No, 5,120,480, describes techniques for making insulated containers of incrementally different sizes and shapes. The containers consist of an inner shell and an outer shell of glass fiber reinforced resin with an insulating foam poured between the shells. Each of the shells is formed upon a mold by laying up glass fibers, either in mat or in chopped fiber form, and resin upon the mold surface in conventional manner. Each mold is formed of assembled elements so as to allow the dimensions of tile mold, and hence the shell, to be incrementally varied. That technique allows the economical production of insulated containers of non metallic construction having a wide range of customized sizes and shapes.

It is necessary to provide a heat extracting means within an insulated container in order for the container to function as the cabinet for a refrigerator or freezer. Such heat extracting means typically comprise an evaporator plate supplied by a refrigerant compressor. Evaporator plate assemblies typically comprise either a plate-type heat exchanger with fluid passageways formed between a pair of metal sheets, or a metal plate having a coil of metal tubing attached thereto. Evaporator plates having set dimensions are commercially available, and are typically installed within the cabinet against one of its inner side walls. In order to obtain adequate performance, the size and shape of the evaporator plate must be matched to the size and shape of the cabinet, or insulated container, to which it is fitted.

Commercially available evaporator plate assemblies come only in a limited number of sizes and shapes, thus severely restricting the variety of size and shape options available to a manufacturer of custom fitted units. Furthermore, an evaporator plate assembly inserted into a refrigerated container has a number of other limitations and drawbacks. In refrigerated containers of usual dimension, long and narrow for example, it is difficult to obtain a rapid initial cool-down and maintain an acceptable temperature profile throughout the container. Because an evaporator plate assembly that is inserted into a refrigerated container is exposed directly to the contents placed in the container, there is always the possibility of physical damage. Also, there is a continuing potential for corrosion of an exposed plate assembly in a marine environment.

Refrigerators and freezers, such as those typically used in a home, use condensing coils to discard heat from the refrigeration process into the atmosphere. Those condensing coils lave conventionally been placed on the outside of the refrigerator cabinet, at the rear thereof. Recent refrigerator designs attach the condensing coils to the inside surface of the outer metal cabinet wall. The metal wall transmits heat from the condensing coils, and provides heat exchange surface to discharge heat into the atmosphere. An example of that type of condensing coil design is shown in a patent to Borghi, U.S. Pat. No. 3,520,581. The condensing coils used by Borghi are of semicircular cross-section, with a flat side which is held against the inner surface of the outer cabinet wall by means of adhesive tape. A recent patent to Patterson, U.S. Pat. No. 5,154,792, discloses certain urethane polymers which exhibit good heat transfer properties and thermal stability. The polymers are used to join cooling and condensing tubes to a metal panel.

Despite the recent advances in designs and materials, there has not been available refrigerant evaporator systems that are adaptable for use in the manufacture of custom sized and shaped refrigerated containers. This invention fills that need.

DISCLOSURE OF THE INVENTION

This invention provides molded refrigerated containers of incrementally different sizes and shapes that are manufactured of fiber reinforced resin, and have integral evaporator coils within the container wall, as well as methods for their construction. The refrigerated container itself consists of an inner shell and an outer shell of fiber reinforced resin with foamed insulation placed between the two shells. A continuous length of metal tubing is coiled about the outer side of the inner shell, forming an evaporator for refrigerant liquid supplied from an external compressor and condenser. The metal tubing is secured in place on the shell wall using a thermally conductive adhesive material. That material comprises a resin that is compatible with the resin laminate forming the inner shell, and contains a conductive medium made up of metal granules. In this fashion, essentially the entire inner wall area of the container becomes a heat exchange surface, providing sufficient heat transfer capacity for the insulated container to perform as a freezer.

Hence, it is an object of this invention to provide an evaporator system suitable for use with refrigerated containers of incrementally varying dimensions.

It is another object of this invention to provide insulated refrigerated containers with walls constructed of fiber reinforced resin shells, and having an evaporator coil disposed with the container wall adjacent the inner shell.

Yet another object of this invention is to provide methods for manufacturing refrigerated containers having integral evaporator coils.

Other objects and advantages of the invention will be apparent from the following detailed disclosure.

DESCRIPTION OF THE PREFERRED EMBODIMENTS

This invention provides refrigerated containers having integrally formed evaporator coils placed within the container wall, and a method for constructing those containers in multiple, incrementally varied sizes and shapes. The container itself is constructed in the manner taught by the inventor's prior U.S. Pat. No. 5,120,480, the disclosure of which is incorporated by reference herein.

Figure 1:
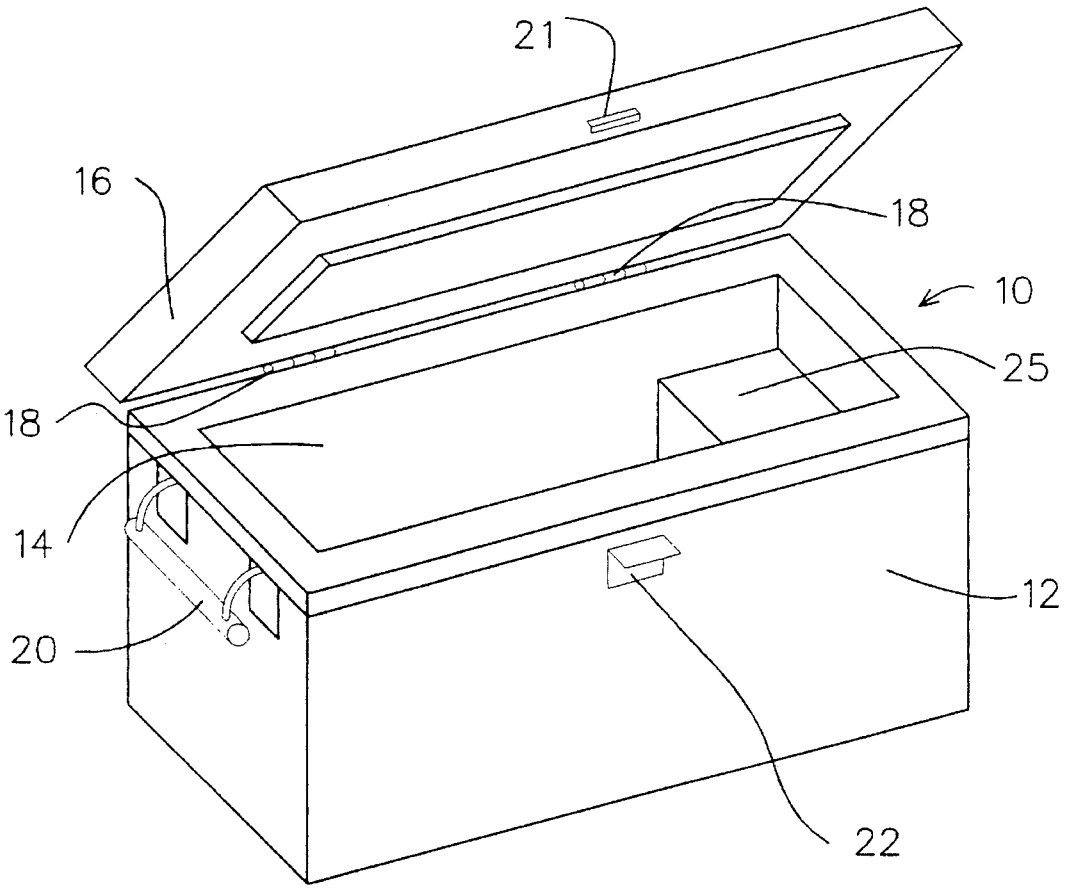
FIG. 1 is a perspective view of a portable, refrigerated container constructed in accordance with the teachings of this invention.

Referring now to the drawings, FIG. 1 illustrates a portable refrigerated container 10 constructed according to the teachings of this invention. The body of container 10 is formed of an outer shell member 12 and an inner shell member 14 with a layer of insulation foamed between the two shells. An insulated lid 16 is attached to the container body by means of hinges 18. Handles 20 are attached to the ends of the container for convenience in lifting and carrying it. The lid may be secured in a Closed position by providing a hook 21 on the lid that mates with a hasp 22 located on the outer container shell. A cavity 25 is provided at one end of the container to accommodate a refrigerant compressor.

The container itself is fabricated by first forming the outer shell 12 and the inner shell 14 on molds in the manner taught by the inventor's prior patent, U.S. Pat. No. 5,120,480. In carrying out this invention, an inner shell 14 is formed upon a mold by first coating the mold with a release agent so that the shell can easily be removed from the mold after its completion. A gel coat, that forms the exposed surface of the inner shell, is then applied over the mold release agent. After the gel coat has had sufficient time to cure, a layer of fiber laminate and molding resin is applied to the mold surfaces. The fiber laminates may either be applied as mats, or as chopped fibers. Any high strength fiber can be used for this purpose, but glass fibers are preferred. The laminate is allowed to cure, and one or more additional laminate layers are applied until the inner shell attains the desired thickness and strength.

Figure 2:
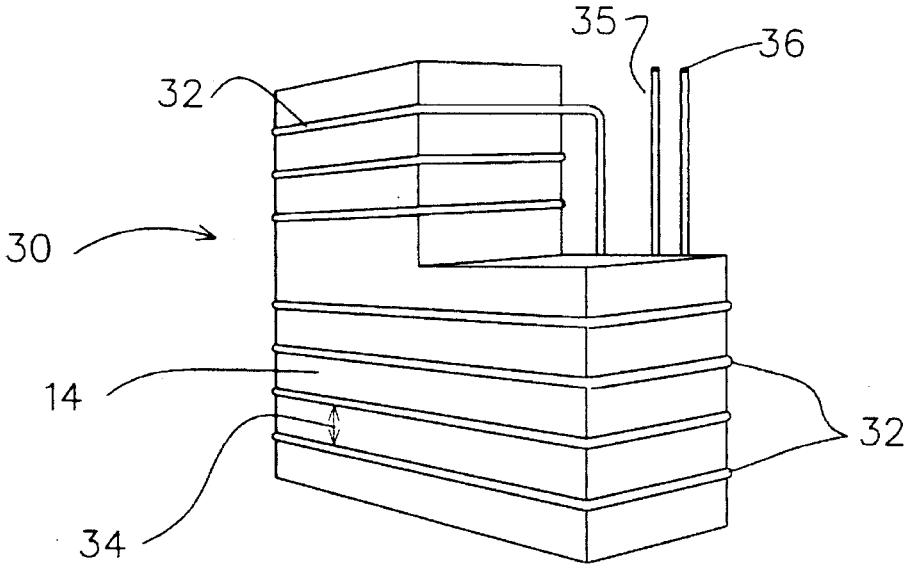
FIG. 2 depicts the inner shell of a refrigerated container in place on its mold, showing placement of evaporator coils.

Referring now to FIG. 2 as well as to FIG. 1, a mold 30 is shown in an upside down position with an inner shell 14 for a refrigerated container formed thereon. An integral evaporator is formed by winding a continuous coil of metal tubing 32, suitably copper, around the exterior surface wall of the inner shell. Use of a continuous length of tubing to form the evaporator ensures that there is no chance of refrigerant leakage during service. Diameter of the tubing is selected as a balance between tubing surface area and pressure drop. For commonly sized refrigerated containers, a tubing diameter of either ¼ inch or ⅜ inch is appropriate. A length of ⅜ of up to about 70 feet is possible without experiencing too high a pressure drop in the evaporator. For larger containers, two or more tubing lengths are manifolded exterior to the container wall, so as to-avoid any possibility of internal leakage.

The shell must be in place on the mold while the metal tubing is wound thereon, as the shell 14 itself does not have enough strength to avoid distortion during the tube winding operation. Adjacent coils are spaced apart a short distance 34, suitably between one and five inches, one from the next. The two coil ends, 35 and 36, extend away from the shell wall for connection to a refrigerant compressor. In this manner, essentially the entire wall of inner shell 14 becomes a heat exchange surface.

Coil 32 is next bonded to the exterior surface of the inner shell using a conductive adhesive preparation that is compatible with the material of the shell wall. The base of the adhesive preparation is preferably the same resin that is used in the fabrication of the shell wall. That resin suitably is a general purpose, polyester laminating resin adapted for room temperature cure. The resin itself is a poor conductor of heat, as are most organic materials. Some specially formulated adhesives have sufficiently good heat transfer properties to be usable in the bonding of metal cooling or condensing tubes to the metal panels of a refrigerator cabinet. However those adhesives do not have a sufficiently high level of thermal conductivity to be operative in this invention. A sufficient level of heat transfer is obtained by mixing granules of a conductive metal, suitably aluminum, with the resin.

Figure 3:
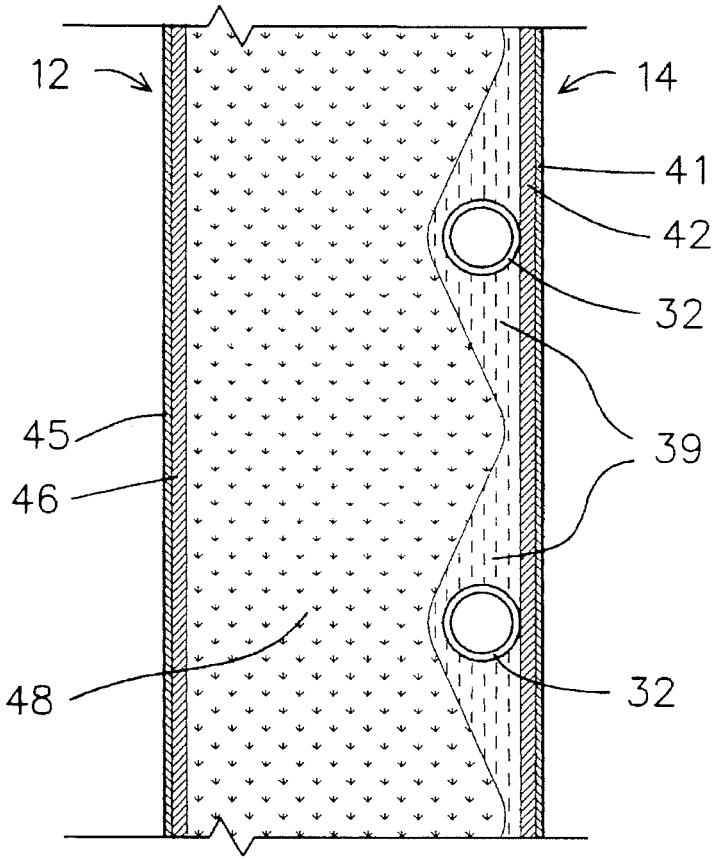
FIG. 3 is a cross sectional view of a vertical wall of the refrigerated container shown in FIG. 1.

Turning now to FIG. 3, there is depicted a cross-sectional view of a container wall constructed in accordance with the teachings of this invention. Inner shell 14 is formed of two layers. One layer consists of a thin gel coat 41 which forms the exposed surface of shell 14, and the other is a laminate layer 42 that provides structural strength to the shell. In similar fashion, outer shell 12 includes a gel coat 45 and a laminate layer 46. Insulation material 48, preferably a foamed in place polymer such as a foamed polyurethane, fills the space between the inner and the outer shells.

Figure 4:
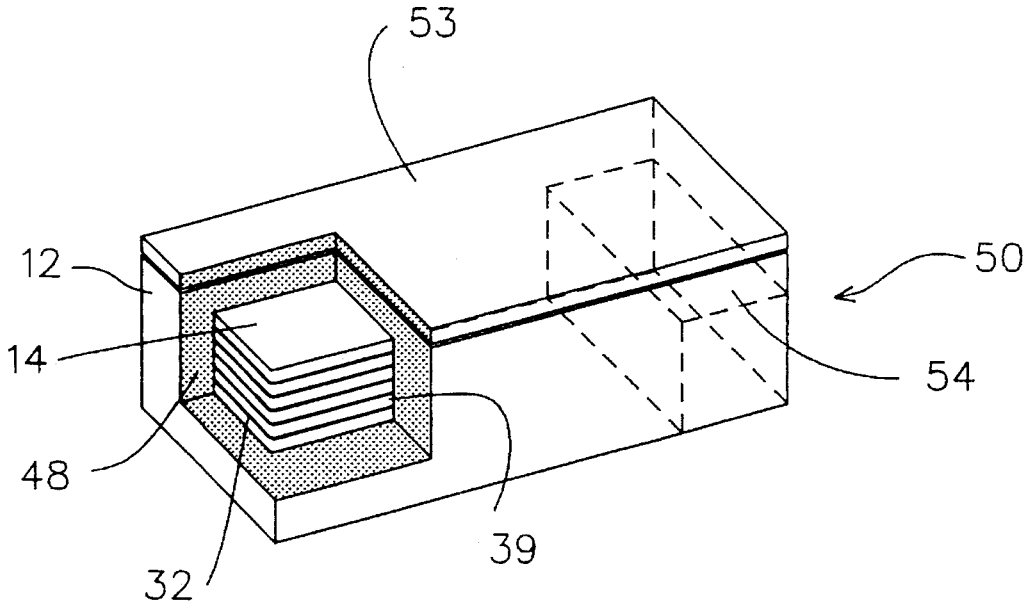
FIG. 4 is a partially cut away, stylized view of a bench style freezer container showing the placement of evaporator coils within the container wall.

Multiple turns of metal tubing are wrapped around shell 14 to form an evaporator coil 32 that extends around essentially the entire vertical wall surface of the inner shell. The arrangement of the evaporator coil is best shown in FIG. 4, which is a partially cut away view of a bench style freezer container 50, typical of those used on sports fishing boats. Container 50 is similar to container 10 (FIG. 1) in construction, having an insulation material 48 foamed in place between an outer shell 12 and an inner shell 14. An insulated, bench-type lid 53 seals the top of the container. A refrigeration compressor is arranged within compressor cavity 54, shown in dotted outline. Refrigerant liquid that is vaporized within evaporator 32 is returned to the refrigeration compressor for compression and condensation to a liquid in accordance with the conventional refrigeration cycle. As is shown in both FIGS. 3 and 4, tubing turns forming the evaporator 32 are disposed adjacent the exterior surface of inner shell 14, and are secured in place by adhesive composition 39. The adhesive is mounded over the tubing, and is extended to form a conductive layer 40 over all, or essentially all, of the shell surface between adjacent tubing turns.

Adhesive preparation 39 necessarily includes granules of a conductive metal dispersed in a resin. Granules of aluminum, such as those sold for casting purposes are preferred. For the purposes of this disclosure, the term "granules" will be taken to mean particles having a diameter of at least about 0.25 mm. Granule diameters ranging from about 0.5 mm to 2 mm are preferred. It has been found that metal powders, powdered aluminum or copper for example,.are not suitable. Compositions made using such metal powders, while better than polymer adhesives alone, display far lower thermal conductivities than do those made with granules. The clear superiority of metal granules over metal powders may reside in the vastly smaller number of metal-polymer boundaries per unit thickness of the applied preparation.

Adhesive preparation 39 preferably includes a strengthening agent and a thickening agent as well, because a simple mixture of metal granules and resin tends to slump and run when it is applied to a vertical surface. A high degree of slump resistance and strength is required to form a continuous layer of the adhesive composition on a vertical surface, as is usually the case when bonding the evaporator coil to the shell wall. If the adhesive preparation 39 slumps and runs, it then fails to form an adequate bonding and heat conducting layer which is necessary to extract heat through the inner shell, and into a vaporizing refrigerant contained within evaporator coils 32. Useful strengthening agents include milled glass fibers of up to about one millimeter in length, and other small fibrous mineral particles having a high aspect ratio; that is a length to diameter ratio of at least about 10. Thickening agents useful in these adhesive preparations comprise very finely divided mineral fillers. Amorphous fumed silica, such as that sold by Degussa Corporation under the tradename Aerosil 200, is particularly preferred as a thickening agent.

Adhesive preparations practical for use in this invention include those containing, by weight, from about 40% to 80% resin; from 10% to 50% metal granules; from 2% to 20% of a strengthening agent; and from 0.5% to 10% of a thickening agent. Preferred compositions range from 50% to 75% of polyester resin; from 15% to 30% of aluminum granules; from 5% to 15% of a mineral fiber strengthening agent; and from 1% to 5% of a finely divided mineral filler as a thickening agent. Specific compositions have been found to provide a combination of extremely desirable properties, including high thermal conductivity, compatibility with other system components, high strength, and good slump resistance. One such exemplary composition contains, by weight, 66% of a general purpose, polyester laminating resin (selected to be the same as the laminating resin used for the container shells); 22% of aluminum granules having a diameter generally between 0.7 mm and 1 mm (U.S. Granules Corporation, Exofine 2095); 10% milled glass fibers in 1/32" stands (PPG Products Code 1440) and 2% of amorphous fumed silica (Degussa Corporation, Aerosil 200)

This invention finds particular use in the manufacture of custom sized refrigerators and freezers for use on sports fishing boats, yachts, recreational vehicles, and portable food handling facilities. Thus, refrigerated containers in a wide variety of incrementally different sizes and shapes can be practically and economically produced through use of this invention.

The embodiments of the invention in which exclusive rights are asserted are set out in the following claims.

I claim:

1. A refrigerated container comprising:

a cabinet having an outer shell forming the cabinet exterior, an inner shell arranged within, but separated from, said outer shell and enclosing a refrigerated space, and a foamed insulating material disposed between the shells, both said outer and inner shells constructed of a first resin that is reinforced with glass fiber;

an evaporator disposed between said outer and inner shells, said evaporator comprising multiple turns of metal tubing wound around the walls of said inner shell to form a coil, said tubing turns spaced apart, one from the next, said evaporator coil arranged to return vaporized refrigerant to a refrigerant compressor; and a heat conducting adhesive bonding agent comprising a second resin that is compatible with said first resin with granules of a conductive metal dispersed therein covering said metal tubing and bonding it to the surface of said inner shell wall, said bonding agent containing at least 10% by weight of metal granules and extending between adjacent tubing turns to form a heat conducting layer on the shell wall surface between tubing turns.

2. The refrigerated container of claim 1 wherein said metal granules are aluminum having an average diameter greater than 0.25 mm, and comprise between 10% and 50% by weight of the adhesive material.

3. The refrigerated container of claim 1 wherein said second resin is identical to said first resin.

4. The refrigerated container of claim 1 wherein said adhesive bonding agent includes between 2% and 20% by weight of a strengthening agent.

5. The refrigerated container of claim 4 wherein said strengthening agent comprises milled glass fibers.

6. The refrigerated container of claim 1 wherein said adhesive bonding agent contains between 0.5% and 10% by weight of a thickening agent.

7. The refrigerated container of claim 6 wherein said thickening agent comprises fumed silica.

8. The refrigerated container of claim 1 wherein said adhesive bonding agent contains between 50% and 75% by weight of a polyester resin, from 15% to 30% by weight of aluminum granules having an average diameter greater than 0.25 mm, from 5% to 15% by weight of a mineral fiber strengthening agent, and from 1% to 5% by weight of a finely divided, mineral thickening agent.

9. The refrigerated container of claim 1 wherein said evaporator coil is formed of a continuous length of copper tubing.

10. The refrigerated container of claim 9 wherein the spacing between adjacent coil turns is between 1 and 5 inches.

11. A method for making refrigerated containers comprising:

forming an inner shell liner for said refrigeration container by applying laminations of glass fiber reinforcing material and a first resin to the surface of a mold;

winding a continuous length of metal tubing around said inner shell liner while said liner is still on the mold to form an evaporator coil having adjacent coil turns spaced apart, one from the next, the evaporator coil ends arranged to return vaporized refrigerant to a refrigerant compressor;

covering said metal tubing and the surface of said inner shell between coil turns with a heat conducting adhesive bonding agent to thereby bond said tubing to the inner shell wall, and to form a heat conducting layer on the shell surface between coil turns, said adhesive bonding agent comprising a second resin that is compatible with said first resin, and having at least 10% by weight of granules of a conductive metal dispersed therein;

forming an outer shell liner for said refrigeration cabinet by applying laminations of glass fiber reinforcing material and a resin to a second mold, said outer shell liner conforming in shape to the inner shell liner, but being proportionally larger than said inner shell liner;

arranging said inner shell liner within, but separated from, said outer shell liner; and foaming an insulating material into the space between the shells.

12. The method of claim 11 wherein the second resin is identical to the first resin, and wherein said metal granules have an average diameter greater than 0.25 mm.

13. The method of claim 12 wherein said adhesive bonding agent includes between 2% and 20% by weight of a strengthening agent, and between 0.5% and 10% of a thickening agent.

14. The method of claim 13 wherein said strengthening agent comprises milled glass fibers, and wherein said thickening agent comprises amorphous fumed silica.

15. The method of claim 11 wherein said adhesive bonding agent contains between 50% and 75% by weight of a polyester resin, from 15% to 30% by weight of aluminum granules, from 5% to 15% by weight of a mineral fiber strengthening agent, and from 1% to 5% by weight of a finely divided, mineral thickening agent.

16. The method of claim 11 wherein said metal tubing is copper, and wherein adjacent coil turns are separated by a distance ranging from 1 inch to 5 inches.

* * * * *